United States Patent [19]

Wolowitz

[11] 3,997,047

[45] Dec. 14, 1976

[54] ATTACHMENT FOR CONVERTING A STANDARD TYPEWRITER INTO A CORRECTING TYPEWRITER

[76] Inventor: William H. Wolowitz, 6905 Persimmon Tree Road, Bethesda, Md. 20034

[22] Filed: Dec. 27, 1974

[21] Appl. No.: 537,027

[52] U.S. Cl. ..... 197/181

[51] Int. Cl.[2] ..... B41J 29/16

[58] Field of Search ..... 197/91, 181

[56] References Cited

UNITED STATES PATENTS

| | | | |
|---|---|---|---|
| 3,149,711 | 9/1964 | Wolowitz | 197/91 |
| 3,154,183 | 10/1964 | Wolowitz | 197/91 |
| 3,204,745 | 9/1965 | Wolowitz | 197/91 |
| 3,204,746 | 9/1965 | Wolowitz | 197/91 |
| 3,595,362 | 7/1971 | Wolowitz | 197/91 X |
| 3,729,081 | 4/1973 | Ozimek et al. | 197/91 X |
| 3,799,316 | 3/1974 | Davidge et al. | 197/91 X |
| 3,882,990 | 5/1975 | Genesio | 197/181 |
| 3,927,747 | 12/1975 | Wolowitz | 197/181 X |
| 3,927,748 | 12/1975 | Wolowitz | 197/181 |
| 3,927,749 | 12/1975 | Wolowitz | 197/181 |

*Primary Examiner*—William H. Grieb
*Attorney, Agent, or Firm*—William D. Hall

[57] ABSTRACT

An attachment for a ordinary electric typewriter to convert it into a self-correcting typewriter. The attachment includes a frame which, when bolted to the frame of the typewriter, extends across the typewriter from one side to the other along a path just rearward of the keyboard and at a level higher than the keylevers.

The frame of the attachment carries two special keys and also carries a rod for operating the backspace keylever when either of said special keys is depressed and a second rod that selects a correcting field of a ribbon, when one of the special keys is depressed, and selects a writing field of a ribbon, when the other of the special keys is depressed.

10 Claims, 6 Drawing Figures

ATTACHMENT FOR CONVERTING A STANDARD TYPEWRITER INTO A CORRECTING TYPEWRITER

BACKGROUND OF THE INVENTION

Error correcting typewriters are well known. In some of these a single composite two color ribbon is used; see, for example, my prior U.S. Pat. No. 3,154,183, issued Oct. 27, 1964, for "Ribbon Shift For Error-Obliterating Typewriters" and No. 3,595,362, issued July 27, 1971, for "Typewriter Backspace and Ribbon-Field Control." In other prior art, two separate ribbons, one a writing ribbon and one a correcting ribbon, are used; see, for example, my prior U.S. Pat. No. 3,149,711, issued Sept. 22, 1964, for "Error-Correcting Typewriter" and U.S. Pat. No. 3,204,746, issued Sept. 7, 1965, for "Typewriter With Error-Correction Features."

The prior art also shows that a so-called correcting key may be added to a typewriter for backspacing to the point of the error and selecting the correcting ribbon field, see my U.S. Pat. Nos. 3,149,711 and 3,595,362, Ozimek et al. U.S. Pat. No. 3,729,081 and Davidge et al. U.S. Pat. No. 3,799,316.

It is also taught in some of my prior copending applications that the error correcting key may be carried by an attachment that may be added to an existing typewriter. In this respect see my prior copending applications Ser. No. 470.476, filed May 16, 1974, now U.S. Pat. No. 3,927,748, issued Dec. 23, 1975, for "Attachment for Typewriters" and Ser. No. 496,602, filed Aug. 12, 1974, now U.S. Pat. No. 3,927,749, issued Dec. 23, 1975, for "Apparatus for Supplementing the Operation of the Ribbon Selecting and Backspacing Means of a Typewriter."

SUMMARY OF THE INVENTION

The present invention is an attachment for a typewriter to give it additional functions. In its preferred form the attachment converts an ordinary typewriter into a self-correcting one.

The attachment comprises mounting means adapted to be attached to a typewriter. The mounting means in the preferred form of the invention carries two keylevers and their associated keys. There are two elongated movable means carried by the mounting means, one of which elongated means extends from said two keylevers to the backspace keylever to depress the latter when either of said first-named two keylevers is depressed. The other elongated movable means extends from said two keylevers (carried by the mounting means) to the ribbon selector to select one ribbon field when one of said two keylevers is depressed and to select another ribbon field when the other of said two keylevers is depressed.

In the preferred form of the invention, the mounting means as well as the two elongated movable means extend at least partway across the typewriter and above the keylevers of the typewriter.

In the preferred form of the invention, the writing and correcting ribbon fields comprise a single composite ribbon, although I do not wish to be so limited, having shown two separate ribbons in my U.S. Pat. No. 3,149,711.

DETAILED DESCRIPTION OF THE INVENTION

Before the improvement constituting the invention is described, two prior art typewriters will first be described. One of these is IBM Standard Typewriter Model C, described in IBM Customer Engineering Instruction Manual, IBM Form 241-5065-1 of December 1960 and Revised in July 1966. The second of these is a later model of the same typewriter, namely IBM Standard Typewriter Model D.

Figure 1:
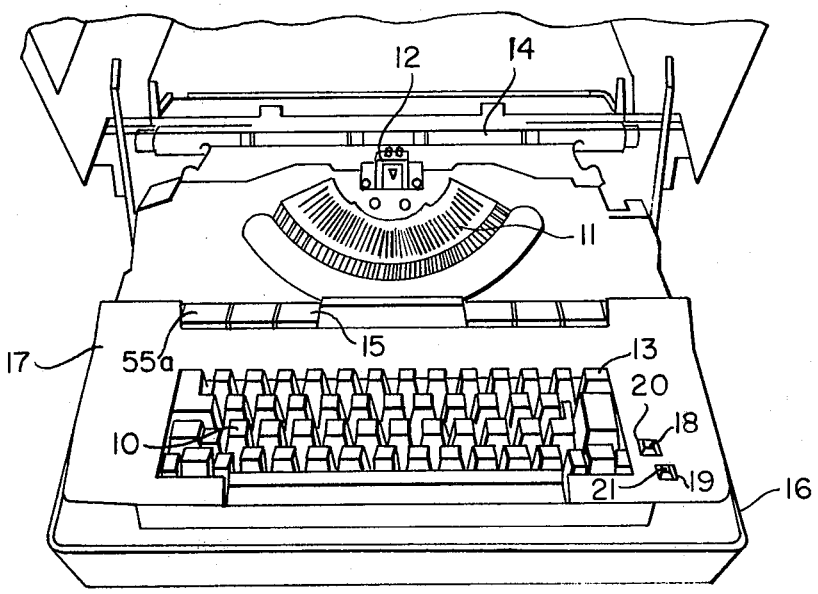
FIG. 1 is a front view of a typewriter to which my invention has been added, the inventive features not, however, being visible.

A pictorial view of the aforesaid model D is shown in FIG. 1, except that my improvement has been added thereto. The standard typewriter has suitable keys, such as 10, operating type-face, such as 11, a ribbon vibrator 12 carrying a two-field ribbon, a backspace key 13 for backspacing the platen 14, and a ribbon selector 15 which will hereinafter be described in more detail.

The typewriter has the usual base plate 16 carrying the frame as well as the operating parts.

All of the foregoing parts 10 to 16 are conventional and the only change that I have made which is visible in FIG. 1 is that the front shield 17 has two square holes 18 and 19 from which two keys 20 and 21 project. Keys 20 and 21 are not a part of the conventional typewriter, as will appear.

When a ribbon is inserted into ribbon vibrator 12, it rests below the line of typing so that the writing line on the paper is always visible. The ribbon vibrator must therefore be raised in front of the typeface when a typebar is operated in order to leave a printed image on the paper.

Figure 2:
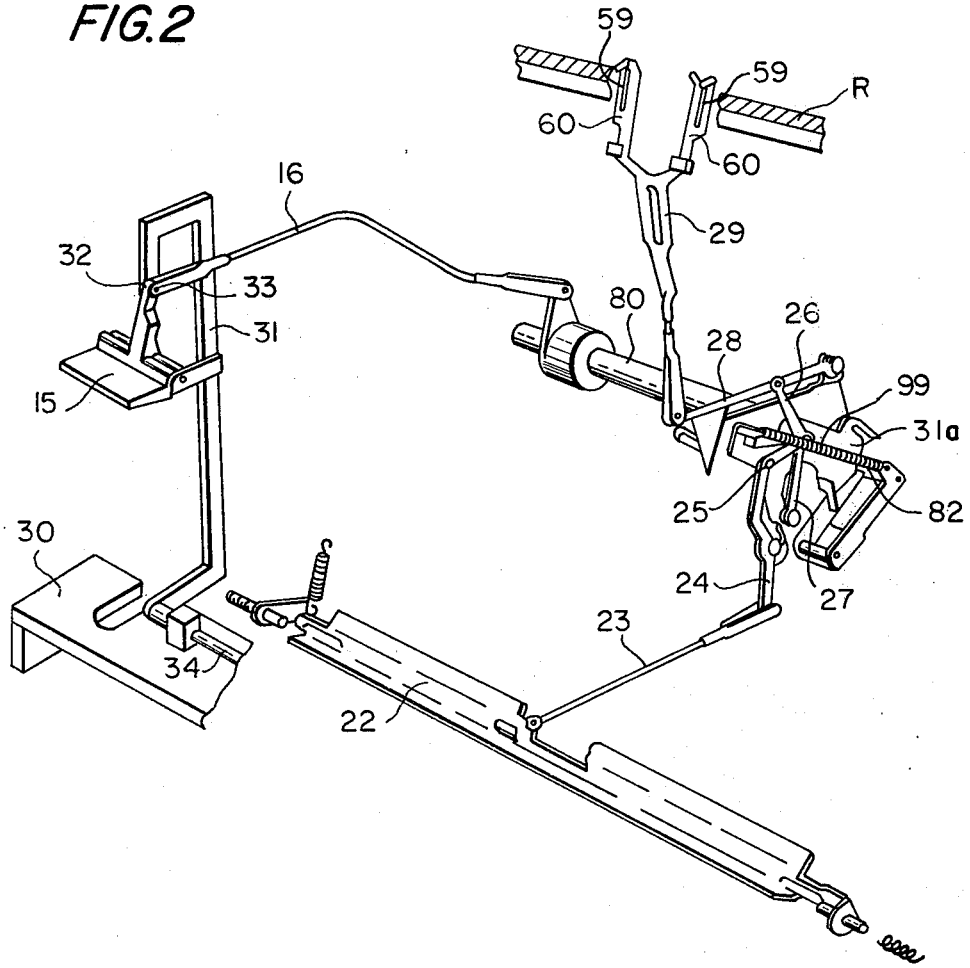
FIG. 2 is a perspective view of a conventional ribbon vibrator and ribbon field selecting mechanism, with one end of my attachment (comprising parts 30 to 34) also being shown.

FIG. 2 illustrates a number of conventional parts of a standard IBM electric typewriter, as follows:

A ribbon field selecting lever 15 (which is pivoted near its rear end) may be operated to control the height of ribbon lift. The lever 15 has four angular positions, providing threee lift positions and a stencil position in which the ribbon is not lifted. The lever 15 is in its stencil position when its front end is in the lowest of its four positions. The three ribbon lift positions utilize the top, middle, and bottom of the ribbon. With a two-color ribbon in the typewriter, the operator will normally use only the top and bottom ribbon positions. To utilize the lower field of a two-field ribbon, the front end of lever 15 is moved to its extreme upward position. To then use the upper field of the ribbon, the front end of lever 15 is moved downwardly by two notches so that it is horizontal.

Operation of any one of the keys 10 effects, in a conventional manner, rotation of the bail 22 about its mounting studs. This rotation of the bail is inherent to both the IBM Model C and the IBM Model D typewriters described above, and the mechanism for achieving such rotation is described in said IBM Customer Engineering Instruction Manual (IBM Form 241-5065-1).

The bail 22 has the ribbon-lift link 23 attached to it. Rotation of the ribbon-lift bail 22, in response to depression of one of the keys 10, pushes the ribbon-lift link 23 to the rear. The link 23 pivots an actuating lever 24 which pulls forward on the center 25 of toggle assembly 25, 26, 27. The angle between the toggle arms 26 and 27 is thus increased, and the ribbon-lift lever 28 raises the ribbon-lift guide 29 of ribbon vibrator 12 and positions the ribbon in front of the typeface.

The only parts shown in FIG. 2 that do not appear in a standard prior art IBM Model C typewriter are the frame 30 of my new attachment, shown carrying arm 31 which has forked end 32 (as shown at 32*a* of FIG. 3), the arms of the fork being respectively ahead of and behind pin 33 so that rotation of shaft 34 moves link 16 forwardly or rearwardly to select the desired field of a two-field ribbon. Pin 33 was, of course, a part of the typewriter before my attachment was added thereto.

The ribbon R is preferably a single composite two-field ribbon, the upper field of which is a black writing portion and the lower field of which is a white correcting portion. The ribbon R is shown broken away just before it enters, and just after it leaves the slots 59, which slots are defined by strips 60 of ribbon-lift guide 29.

The amount of ribbon lift obtained is dependent upon the angle of the two toggle arms 26 and 27. This angle is varied by changing the position of the "Ribbon Selector" lever 15. A link 16 from this lever rotates a shaft 80 and its attached positioning plate 31*a*. The positioning plate 31*a* controls the angle of the toggle assembly 25, 26, 27 by positioning the lower toggle arm 27 which is attached to it. A spring-loaded detent roller 82 holds the plate in one of four positions.

In the stencil position the lower arm 27 is positioned almost in a straight line with the upper arm 26. The motion from the ribbon-lift bail 22 pulls the toggle over center and the ribbon is not noticeably lifted.

When the front edge of the "Ribbon Selector" lever 15 is lifted from the stencil position, the lower toggle arm 27 rotates and forms an angle with the upper arm 26. The higher the lever position is, the sharper is the angle between the toggle arms 26 and 27, and the greater is the amount of ribbon lift.

Figure 3:
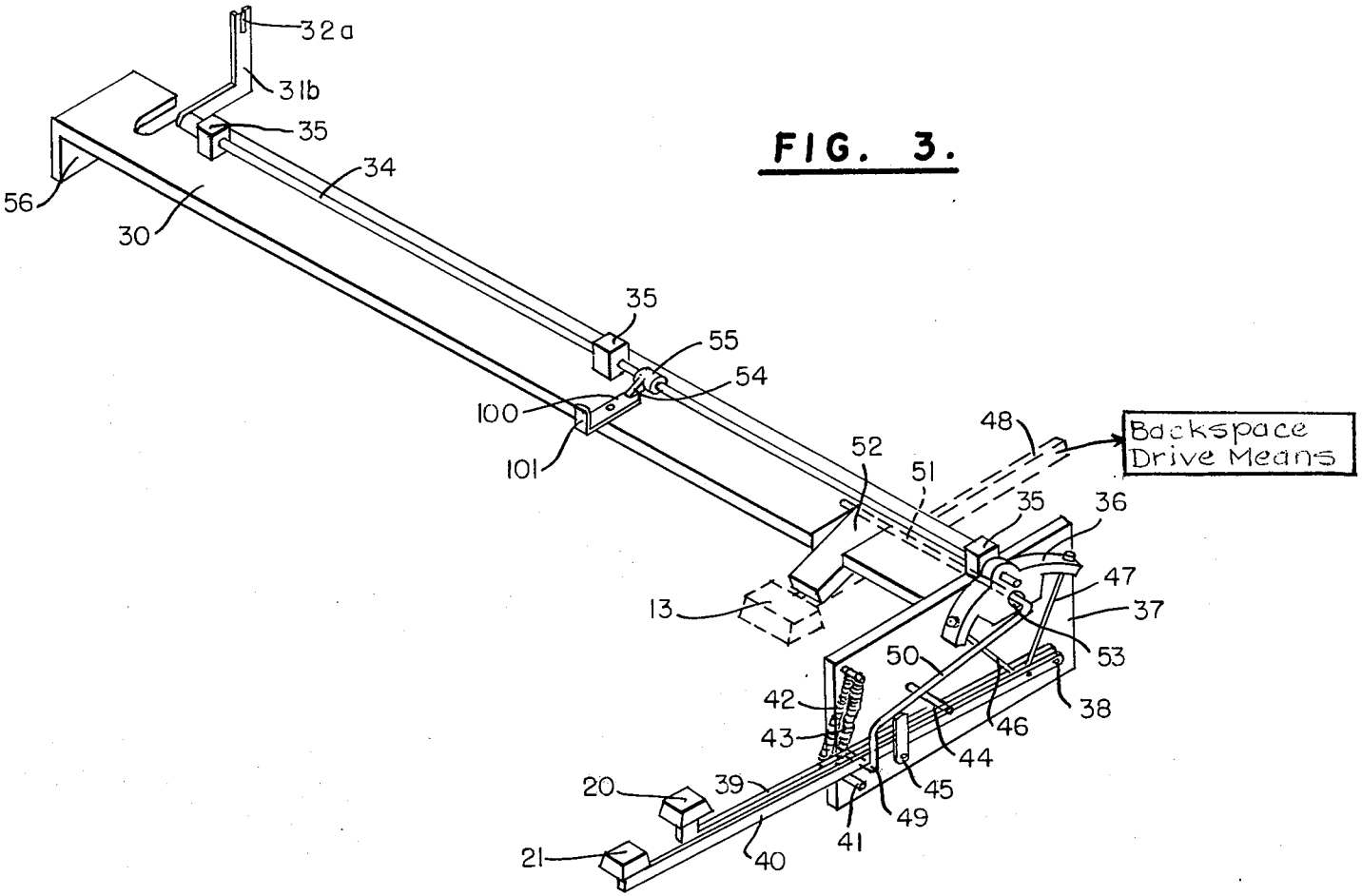
FIG. 3 is a perspective view of my novel attachment; the conventional backspace key 13, conventional backspace keylever 48 and the conventional backspace drive means also are shown.

FIG. 3 illustrates my new attachment. The shaft 34 is carried by three bearings 35, and at its right-hand end, as shown in FIG. 3, has a lever 36 secured thereto. The frame 30 includes a vertical plate end piece 37, which has a pivot 38 upon which key levers 39 and 40 (which respectively carry keys 20 and 21) are mounted for rotation. The downward travel of keylevers 39 and 40 is limited by pin 41. The keylevers 39 and 40 are respectively biased upwardly by springs 42 and 43 and the upward travel is limited by pin 44. The outward motion, away from frame 37, is limited by vertical arm 45.

When key 20 is depressed, the keylever 39 moves downwardly, pulls downwardly upon rod 46 which is pivotally attached to keylever 39, and thus rotates arm 36 counterclockwise. This in turn rotates shaft 34 and moves arm 31*b* forwardly. When key 21 is depressed, keylever 40 moves downwardly, pulling rod 47 (which is pivotally attached to keylever 40) downwardly, thus rotating parts 31, 34 and 36 clockwise and moving the upper end of arm 31*b* (having forked end 32*a*) rearwardly.

As will appear, it is desired to operate the backspace means of the typewriter when either one of keys 20 and 21 is operated. The typewriter has a conventional backspace key 13 with a conventional backspace keylever 48, which, when depressed, operates the conventional backspace drive means which backspaces the typewriter one letter space in a conventional manner, as more fully explained on pages 99 to 103 of said IBM Customer Engineering Instruction Manual, IBM Form 241-5065-1.

When either of keys 20 or 21 is depressed, its associated keylever 39 or 40 presses downwardly on the lower part 49 of arm 50 which is integral with shaft 51 and arm 52. The arm 52 therefore rotates with its forward end moving downwardly to depress the backspace keylever 48 and thus operate the backspace drive means to backspace the typewriter. The shaft 51 operates in a cylindrical hole extending in frame 30 and there is a large hole 53 in arm 36, so that shaft 51 may pass therethrough without arm 36 ever touching shaft 51.

The angular counterclockwise rotation of shaft 34 is limited by arm 54 which is secured to the shaft 34 by means of a collar 55.

When an attachment according to my invention is made for the aforesaid IBM Model C, the lever arm 31 has the shape shown in FIG. 2 so that the forked arms 32 approach pin 33 from above. In contrast with the aforesaid Model D IBM typewriter, the arm 31 and forked arms 32 pass upwardly through, or slightly behind the slot in the rear part of Margin Release lever 55*a* to engage pin 33. In the Model D typewriter, pin 33 is located at a higher level than, and slightly rearwardly of, lever 55*a* but is driven forwardly and rearwardly by lever 15. Thus, for the IBM Model C, the arm 31 has the shape shown in FIG. 2, and for the IBM Model D, the arm 31 has the shape shown in FIG. 3.

Figure 4:
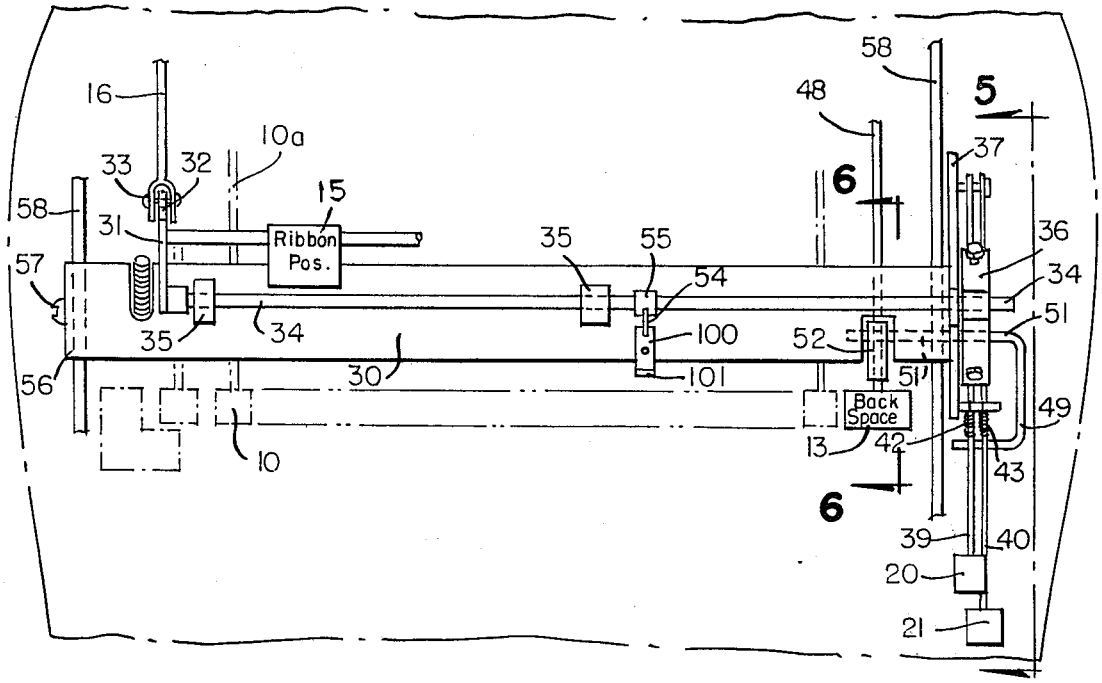
FIG. 4 is a partial top view of a conventional typewriter with my attachment added thereto.

FIG. 4 is a top view of my new attachment installed on an aforesaid Model D typewriter. My attachment has a vertical ear 56 which is attached by bolt 57 to the frame 58 of the typewriter. That frame has an existing threaded hole which may be used to receive bolt 57. Similarly, frame plate 37 is also bolted to an existing bolt hole in the frame 58 of the typewriter.

My attachment may be added to the existing IBM typewriters described above for the purpose of converting them into self-correcting typewriters. To accomplish this, a two-color ribbon R, having a black upper field and a white (cover-up) lower field, is installed in the typewriter, and is passed through the slits 59 in ribbon holder 60 of the ribbon lift guide 29 (see FIG. 2).

A substitute cover plate 17 having holes 19 and 20 in it replaces the conventional cover plate.

The typewriter may be used for ordinary typing by positioning ribbon field selector 15 to select the black ribbon field. As will appear later, alternatively the typewriter may also be made ready for ordinary typing by pressing key 20 which, as will appear, selects the black (upper) ribbon.

Figure 5:
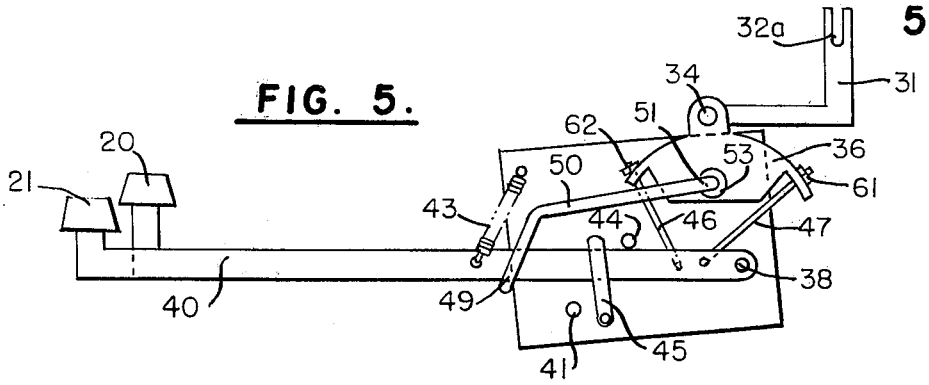
FIG. 5 is an end view of my attachment, taken along line 5—5 of FIG. 4.
Figure 6:
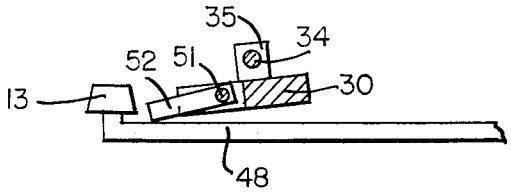
FIG. 6 is a sectional view of my new attachment taken along line 6—6 of FIG. 4.

If next the typist makes a mistake, as for example, by depressing the wrong key for the last letter of a word, the backspace key 21 (which is properly called either a "correction key" or an "error key") is first depressed to select the white lower ribbon field as well as to backspace the typewriter to the place where the error is located. Depression of correction key 21 rotates both lever 36 and rod 34 clockwise (FIG. 5) and thus moves arm 31 and link 16 to achieve maximum lift of the ribbon-lift guide 29. To achieve exactly the correct amount of motion of link 16, the rod 47 has its outer end threaded and a bolt 61 (FIG. 5) can be adjusted so that downward motion of lever 40, until it reaches stop pin 41, rotates rod 34 the correct amount to select the lower (white) field of the ribbon.

The typist next depresses that particular key on the keyboard which corresponds to the incorrectly typed letter, thus effecting a covering-up of the incorrectly typed letter as the typeface representing the incorrect letter types through the lower (white) portion of the ribbon.

The typist then depresses the additional backspace key 20, thus backspacing the typewriter and selecting the black (upper) field of the ribbon, so that the correct letter may then be typed.

In order to carry out the last-named function, the outer end of rod 46 is threaded and an adjusting bolt 62 is positioned so that when key 20 is depressed, the rod 34, lever 36 and arm 31 rotate just enough to move link 16 forwardly to the correct position to cause the ribbon-lift guide 29 to select the black field of the two-color ribbon. To insure that there is no overtravel, arm 54, which is secured to collar 55 which is secured to shaft 34, engages stop 100 to limit the motion of shaft 34. The lever 36 has holes through which rods 46 and 47 pass, which holes are of greater diameter than the rods themselves, so that there will be enough lost motion to avoid binding when keys 20 and/or 21 are depressed.

When it is desired to move ribbon selector 15 to the stencil position, stop 100 is rotated by handle 101 out of the way of arm 54. This permits arm 54 to rotate into contact with plate 30 when lever 15 is rotated to stencil position.

It is clear, therefore, that when my attachment is added to a typewriter all ordinary typewriter functions can still be performed on the typewriter in the normal manner. Thus, the regular backspace key 13 of the typewriter operates in quite the same way whether or not my attachment is used. Similarly, all three ribbon selecting positions of ribbon selector 15 are available by manual adjustment of lever 15, whether or not my attachment is used. Moreover, the stencil position of ribbon selector 15 may be used if stop 100 is rotated out of the way of arm 54.

While I have shown and described an additional backspace key 20, this key is not required and could be omitted. If it were omitted, the typewriter could still be operated as a self-correcting typewriter as follows: In event the typist depresses the wrong key and thus prints an incorrect character, the key 21 woul then be depressed to backspace the typewriter to the point of the error and to shift to the lower (white) half of the ribbon R.

The typist would next depress the key representing the incorrect character to cover up the error. The escapement could be inhibited when this key is depressed as, for example, by manually holding the carriage or by other prior art means or methods. Alternatively, normal escapement could be allowed and the typewriter could be backspaced with regular backspace key 13.

The upper (black) ribbon field would then be selected by operation of ribbon selector 15, or in any other known way, and the proper key could then be depressed to print the correct character. Normal typing could then resume.

I claim to have invented:

1. An attachment for a typewriter of the type having backspace drive means; a keyboard having a plurality of keys, including a backspace key, with keylevers for said keys that extend rearwardly thereof, said backspace keylever operating the backspace drive means; ribbon vibrator means; a ribbon field selecting mechanism for controlling said ribbon vibrator means to select the ribbon field thereof which is to be used, said ribbon field selecting mechanism including a manually operated element; said attachment comprising:

a. a mounting element adapted to be secured to said typewriter so that it extends above at least some of said keylevers including the backspace keylever and also extends to a position adjacent at least a portion of said ribbon field selecting means, b. a key having a keylever supported by said element, c. means carried by said element, to depress said backspace keylever, when said last-named key is depressed, comprising first elongated movable means extending from said keylever supported by said element along said element to a position adjacent said backspace keylever, and d. second elongated means extending along said mounting element from said keylever supported by said element to a position adjacent said ribbon field selecting means and then extending to operatively engage the ribbon field selecting mechanism, said second elongated movable means including means for moving said ribbon field selecting mechanism to select a given ribbon field when said last-named key is depressed.

2. Apparatus according to claim 1 in which said typewriter also includes a frame, said mounting elment including means whereby the mounting element may be secured to said frame and supported thereby.

3. Apparatus according to claim 1 in which there are writing and correcting ribbon fields, and the key of element (b) is a correcting key which when depressed backspaces the typewriter and selects the correcting field.

4. Apparatus according to claim 3 in which there is an additional key supported by said mounting element, said means of element (c) also being responsive to depression of said additional key for depressing and backspace keylever, and said means of element (d) also including means for operating the ribbon field selecting means to select the writing field when said additional key is depressed.

5. In a typewriter of the type having backspace drive means; a keyboard having a plurality of keys, including a backspace key; keylevers for said keys that extend rearwardly thereof; said backspace keylever operating the backspace drive means; ribbon vibrator means; a ribbon field selecting mechanism for controlling said ribbon vibrator means to select the ribbon field thereof which is to be used;

a. a correcting key adjacent one end of the keyboard and b. elongated movable means located adjacent to but rearwardly of the keyboard and extending above and transverse to at least some of said keylevers, including the backspace keylever, for depressing the aforesaid backspace keylever and also operating said ribbon field selecting mechanism to select a given ribbon field when said correcting key is depressed.

6. In a typewriter as defined in claim 5, said ribbon vibrator means including means for lifting a composite two-field ribbon to different heights so that different fields of the single composite ribbon may be used.

7. In a typewriter as defined in claim 5, an additional key adjacent the correcting key, said elongated movable means including first and second movable elements and also including means to operate the first element, to depress the backspace keylever, when either the correcting key or said additional key is depressed, and the second movable element including means for moving the second movable element in one direction when the correcting key is depressed and in the other direction when said additional key is depressed, said second movable element including means for operating the ribbon field selecting means to select one ribbon field when the second movable element in moved in one direction and to select another ribbon field when said second movable element is moved in the other direction.

8. In a typewriter as defined in claim 7, said ribbon vibrator means including means for lifting a composite two-field ribbon to different heights so that different fields of the single composite ribbon may be used.

9. An attachment for a typewriter of the type having backspace drive means; a keyboard having a plurality of keys, including a backspace key; keylevers for said keys that extend rearwardly thereof; said backspace keylever operating the backspace drive means; ribbon vibrator means; a ribbon field selecting mechanism for controlling said ribbon vibrator means to select the ribbon field thereof which is to be used, said ribbon field selecting mechanism including a manually operable element; the ribbon field selecting means being adjacent one side of the typewriter and the backspace key being adjacent the other side of the typewriter, said typewriter having a single composite ribbon carried by said ribbon vibrator means which ribbon has a writing field and a correcting field; said attachment comprising:

a. a mounting element adapted to be secured to and supported by said frame and which, when so secured, extends from adjacent one side of the typewriter to a position adjacent the other side along a path that is adjacent to and rearward of the keyboard as well as adjacent to and above a plurality of said keylevers including the backspace keylever, b. a correcting key and an additional key, each having a keylever supported by said mounting element, c. means for biasing said correcting key and said additional key upwardly and for limiting their upward movement, d. a rod, a limited portion of which extends beneath the keylevers of said correcting and said additional keys, and which portion is moved downwardly when either of said keys are depressed, said rod extending to said element and having a central portion of higher elevation than the backspace keylever extending along said element which central portion rotates when said limited portion is moved downwardly.

e. means supported by said mounting element and driven by rotation of said rod in response to depression of either said correcting key or said additional key, to move downwardly and engage the backspace keylever to backspace the typewriter, f. a second rod, of higher elevation than said first-named keylevers, extending along said mounting element from a position adjacent the correcting key to a position adjacent the ribbon field selecting means, g. connecting means extending from said correcting and additional keylevers to one end of said second rod to rotate the second rod in different angular directions respectively when the correcting and additional keys are depressed, and h. means extending from the other end of said second rod and engaging said ribbon field selecting means to move it to the position at which the correcting field is selected when the correcting key is depressed and to move it to the position at which the writing field is selected when said additional key is depressed.

10. An attachment for an existing typewriter that will give it additional functions, said typewriter having backspace means including a backspace key, also having ribbon field selecting means including a manually operable device for controlling the ribbon field selecting means, also having printing keys and also having keylevers for all of the aforesaid keys, comprising:

mounting means carrying the attachment and adapted to be attached to an existing typewriter, to position it at a higher level than said keylevers, extending above the backspace keylever and extending to a position adjacent said ribbon field selecting means, a first key having a keylever carried by said mounting means, a second key having a keylever carried by said mounting means, supplementary backspace means operated by the depression of either of said first or second keys for operating said first-named backspace means, all without preventing the typist from operating said backspace means that is a part of said typewriter, comprising movable means carried by said mounting means and extending from the keylevers of said first and second keys to the first-named backspace means for operating the latter when either of said first or second keys is depressed, and supplementary ribbon field selecting means which operates the ribbon field selecting means that is on the existing typewriter, to insure that said ribbon field selecting means that is on the existing typewriter is in one position after said first key has been depressed and is in another position after said second key has been depressed, without preventing the typist from also manually selecting the printing fields of the ribbon by operating said ribbon printing field selecting means that is on the existing typewriter, comprising elongated movable means carried by said mounting means and extending from said keylevers of said first and second keys to the ribbon field selecting means for operating the latter in accordance with which one of said first and second keys is depressed.

* * * * *